US005727995A

United States Patent [19]

Harkins et al.

[11] Patent Number: 5,727,995

[45] Date of Patent: Mar. 17, 1998

[54] ROTARY PEENING TOOL

[75] Inventors: Brian Godfrey Harkins, Collegeville; Robert Walter Hoeflein, Paoli, both of Pa.; Christopher Paul Dee, Leamington Spa, England; Florence Beatrice Mallet, Wayne, Pa.

[73] Assignee: Trelawny Pneumatic Tools Division of Fulton Group Ltd., Malvern, Pa.

[21] Appl. No.: 328,315

[22] Filed: Oct. 24, 1994

[51] Int. Cl.[6] ..... B23F 19/05; B24D 9/00

[52] U.S. Cl. ..... 451/463; 451/465; 451/466

[58] Field of Search ..... 451/92, 463, 466, 451/469, 468, 465, 456, 453, 450, 75

[56] References Cited

U.S. PATENT DOCUMENTS

| | | | |
|---|---|---|---|
| 3,545,996 | 12/1970 | Duncan | 117/8 |
| 3,638,464 | 2/1972 | Winter et al. | 72/53 |
| 3,648,498 | 3/1972 | Voss et al. | 72/53 |
| 3,834,200 | 9/1974 | Winter | 72/53 |
| 3,857,750 | 12/1974 | Winter et al. | 161/87 |
| 4,274,676 | 6/1981 | Chapel | 299/64 |
| 4,403,534 | 9/1983 | Altendorf et al. | 83/100 |
| 4,438,977 | 3/1984 | Chapel | 299/64 |
| 4,462,381 | 7/1984 | Fushiya et al. | 125/4 |
| 4,616,496 | 10/1986 | Hawkins | 72/53 |
| 4,616,497 | 10/1986 | Harman et al. | 72/53 |
| 4,616,498 | 10/1986 | Bevilacqua et al. | 72/53 |
| 4,619,128 | 10/1986 | Harman et al. | 72/53 |
| 4,841,681 | 6/1989 | Dickson | 451/92 |
| 5,047,089 | 9/1991 | Grant | 134/21 |
| 5,155,945 | 10/1992 | Tyler et al. | 451/463 |
| 5,187,904 | 2/1993 | Tyler et al. | 451/463 |
| 5,203,189 | 4/1993 | Lovejoy et al. | 72/53 |
| 5,257,479 | 11/1993 | Swain | 451/92 |
| 5,284,039 | 2/1994 | Torgerson | 72/53 |
| 5,297,363 | 3/1994 | Schroder et al. | 51/170 |
| 5,441,443 | 8/1995 | Roberts | 451/92 |

FOREIGN PATENT DOCUMENTS 1 259 898 1/1972 United Kingdom .

OTHER PUBLICATIONS

DESCO Advertisement (date unknown).

DESCO Product Specification, pp. 3 (date unknown).

Unique System Advertisement (May 1994).

Unique Systems Product Specification (date unknown).

Unique System Product Specification (date unknown).

Unique Systems Product Specification (1992).

DESCO Product Advertisement/Specification Copyright 1991–1992.

*Primary Examiner*—James G. Smith
*Assistant Examiner*—Derris H. Banks
*Attorney, Agent, or Firm*—Seidel, Gonda, Lavorgna & Monaco, PC

[57] ABSTRACT

A surface preparation tool for peening and removing a coating from a work surface, the tool including a rotating hub which retains a plurality of peening flaps with peening particles attached at one end. The peening particles impact the work surface as the hub rotates and cause the coating to fragment and dislodge from the work surface. The tool includes a shroud assembly with a funnel-shaped evacuation port attached thereto. The shroud is positioned above the work surface such that a gap is formed which permits air to enter into the shroud. A sealing structure is affixed to the rear wall of the shroud to block air flow into the shroud below the funnel. When a vacuum is applied to the funnel, the narrow gap formed between the shroud and the work surface accelerates ambient air flow into the shroud while preventing dislodged particles from escaping. The rear wall seal prevents air from flowing into the shroud below the funnel which would oppose the direction of flow from the other three sides into the funnel. This results in a directional airflow, aligned to carry dislodged particles into the funnel mouth. The flaps are mounted at a height which maximizes the life of peening flaps. The height is configured to produce a substantially vertical impact of the peening particles on the work surface with a resulting rebound of the flaps that carries the peening particles away from the surface thereby minimizing the wear of the flaps.

34 Claims, 5 Drawing Sheets

ROTARY PEENING TOOL

FIELD OF THE INVENTION

The invention is related to the general field of rotary tools, and to the more specific field of rotary tools for shot peening and removing coatings from a work surface.

BACKGROUND OF THE INVENTION

Rotary tools for shot peening, usually referred to by the abbreviated form "roto-peening tools", are used for the same purposes as a free shot peening process. Hard particles or "shot", as they are commonly called, are impelled against the surface of a metal or concrete workpiece. Each impact produces a localized compressive stress on the surface sufficient to cause lateral stretching or "dimpling" of the workpiece material, and the cumulative effect of these numerous small impacts tends to place the material in compression and relieve pre-existing tensile stresses which may exist in the workpiece. Unlike free shot processes, however, in roto-peening the hard shot particles are contained on a rotating strap or flap.

Roto-peening devices are generally lightweight, transportable band-tools, which use a plurality of peening flaps mounted at one end to a rotating hub, circumferentially spaced from each other by equal degrees of arc around the hub, and extending radially from the hub. Each flap has one or more shot peening particles affixed to its free end. During operation, the rotating hub is held above the work surface to permit the peening particles to impact the surface as the flaps rotate. An example of such roto-peening tools is disclosed in U.S. Pat. No. 3,857,750, which also describes the purpose and effect of "free-shot" peening which proceeded it. That is, the individual shot produce shallow, rounded over-lapping dimples in the surface, stretching it radially from each point of impact and causing cold working and plastic flow which tends to relieve tensile stresses that contribute to stress-corrosion cracking. Thus, peening is often performed as a surface preparation just prior to painting or applying other coatings.

Various configurations of roto-peening flaps are well known and are described in detail in at least U.S. Pat. Nos. 3,834,200, 5,203,189 and 5,284,039. Instead of embedding spheroid peening particles in the web, the more advanced flaps have a metal support base or "button" of ductile metal into which several hard peening particles or "hubs" are set in a pattern and metallurgically joined to the base. U.S. Pat. No. 3,834,200 discloses a type of flap in which the peening buttons are inclined to the strap so that less deformation of the strap is required to make the buttons strike normal (perpendicular) on the surface. U.S. Pat. No. 5,203,189 discloses the type of peening flap which is now preferred for use with the present invention, and which are sold by Minnesota Mining and Manufacturing Company as P-7 Heavy Duty roto peen flaps.

In recent years, roto-peening devices have also been used to remove unwanted surface contamination, such as mill scale, corrosion, old paint and other coatings. U.S. Pat. No. 3,857,750 describes that shot peening can be combined with abrasive cleaning, in which scale is shocked loose by the peening particles and whisked away by abrasive particles embedded in the flap. Some contemporary surface preparation tools, as will be described below, merely use the peening flaps without additional abrasive to scrape away surface contamination. Such devices are particularly useful in preparing old surfaces for refinishing, such as bridge trestles, building girders and similar types of support structure, metal walls, ship hulls, and concrete walls and floors. The rotating peening particles dislodge old paint and corrosion from the surface, leaving behind the bare metal or concrete substrate with a shallow groove-pattern imprinted in the surface from the rotating particles.

However, in situations where the coating or the substrate contains particles of toxic or irritant substance, such as lead-based paint or asbestos dust, there is a potential hazard that toxic particles may be released into the air and inhaled by workers in the vicinity. Recognizing these hazards, manufacturers have produced roto-peening tools which incorporate a shroud over the rotating flaps to capture the particles, and a vacuum source for evacuating the particles from the shroud. Examples of such prior art systems are the Model 10214 roto-tool sold by Unique Systems, and the M225 Mini-Flushplate roto-tool sold by Desco Manufacturing Company, Inc. These devices locate a rotary hub containing peening flaps within a shroud/housing, and provide a vacuum port attached to the housing aft of the hub to evacuate particles dislodged from the substrate.

A shortcoming of these prior devices is that they have a relatively small port in the housing for suctioning out the particles, and they do not provide a controlled flow pattern for the dislodged particles to follow into the port. As a result, the dislodged particles tend to be caught in the movement of the flaps and swirl around under the housing until they slow and migrate to the port. If an edge of the shroud is lifted away from the surface during operation, particles billow out into the surrounding atmosphere. Thus, an object of this invention is to provide a tool in which dislodged particles are evacuated directly from the surface without swirling around in the shroud, and which effectively captures and evacuates essentially all of the dislodged particles to minimize air contamination.

As described in U.S. Pat. No. 5,203,189, the peening flaps wear rapidly where adjacent flaps impinge on one another, where the flaps impact abrasive material (scale, rust) on the surface, or where loose particles of the abrasive material become sandwiched between the flaps. Hence, another object of the invention is to keep the flaps from impinging on each other and, as stated above, to evacuate abrasive the particles as they are dislodged from the surface to prevent them from being caught in the flaps.

Another shortcoming of the prior roto-peen surface preparation devices is that the height of the hub above the work surface is configured to force the peening flaps and the peening hubs to impact and drag laterally across the surface to scrape away the surface coating, leaving grooves in the substrate instead of the desired shallow, rounded overlapping dimples. More particularly, the manufacturer of the P-7 roto-peening flaps recommended that its flaps be mounted in the hubs at a height sufficient to produce a "work surface interference" of approximately 3/16th of an inch. Work surface interference is defined as the difference between the radial length of the flaps and the distance between the center of rotation of the hub and the work surface. That is, the amount of interference with the normal flap trajectory that occurs by the flaps impacting the work surface. This will be discussed in more detail hereinbelow. Furthermore, the manufacturer also recommended that a 0.6 Hp motor be utilized to maintain an operating rotational speed of 2500–3000 rpm.

This combination of height, speed and power was configured to cause the hard peening hubs to scrape laterally across the surface without bowing the flaps to the point where they begin to strike each other. The effect on the work surface is a scarifying and scraping off of the surface coating, and the cold working of the substrate with a resulting grooved appearance rather than the overlapping dimples of true peening. There are several disadvantages to using the peening flaps as scrapers. The lateral scraping action produces a "back-torque" reaction in the tool that tends to lift the front end of the tool away from the surface. The scraping of the work surface with the hard peening nubs results in wear of the peening buttons and hubs five times sooner than if the surface were instead peened. Also, when a thick adherent coating is removed, such as a high density epoxy or a grease paint, the spaces between the nubs quickly become clogged by the coating reducing their effectiveness. Thus, another object of the invention is to provide a tool in which the face of each peening button strikes essentially normal to the surface, thereby transferring its momentum vertically through the hard hubs to fracture the coating into particles and break its adhesion to the substrate while, simultaneously, producing a peening pattern of shallow, rounded over-lapping dimples in the substrate. It is a further objective that the flap impact be configured to produce a rebound or bowing of the flap which prevents the flap from dragging along the surface yet does not permit the flaps to impact one another.

These and other objects and advantages of the invention will become apparent upon reading the description which follows.

BRIEF SUMMARY OF THE INVENTION

The invention is a new surface preparation tool for peening and removing a coating from a work surface. It is a tool of the "roto-peening" type, in which a rotating hub retains a plurality of peening flaps of the type in which a flexible strap is retained in the hub at one of its ends and contains one or more peening particles at or near its other end. The peening particles impact the work surface as the hub rotates and cause the coating to fragment and dislodge from the work surface. The tool is characterized by a shroud assembly having a funnel-shaped evacuation port and rollers which support the open bottom of the shroud above the work surface to create a narrow gap between the shroud and work surface, and a sealing structure on the rear wall to block air flow through the gap below the funnel.

The shroud assembly greatly improves the capture and removal of particles dislodged from the work surface. Potentially hazardous materials have to be kept in the hood and evacuated to the trap in the vacuum line. This is accomplished by the directional airflow created into and out of the shroud. When a vacuum is applied through the funnel, the narrow gap formed at the front and sides between the shroud and the work surface accelerates ambient air flow from outside the shroud through the gap while preventing dislodged particles from escaping. The rear wall seal provides a mechanical barrier to escaping particles, and simultaneously blocks an air flow into the shroud below the funnel which would oppose the direction of flow from the other three sides into the funnel. Additionally, the direction of flap rotation causes the flaps to act as an air pump in an assisting direction. This results in a directional airflow, aligned to carry dislodged particles into the funnel mouth.

The tool is also designed with an optimum work surface interference which maximizes the life of peering flaps while permitting the removal of surface coatings. The work surface interference is configured to produce a substantially vertical impact of the peering particles on the work surface with a resulting rebound of the flaps that carries the peening particles away from the surface thereby minimizing the wear of the flaps.

BRIEF DESCRIPTION OF THE DRAWINGS

For the purpose of illustrating the invention, the drawings depict an embodiment of the invention which is presently preferred. However, it should be understood that this invention is not limited to the precise arrangements and instrumentalities shown.

DETAILED DESCRIPTION OF THE TOOL

Figure 1:
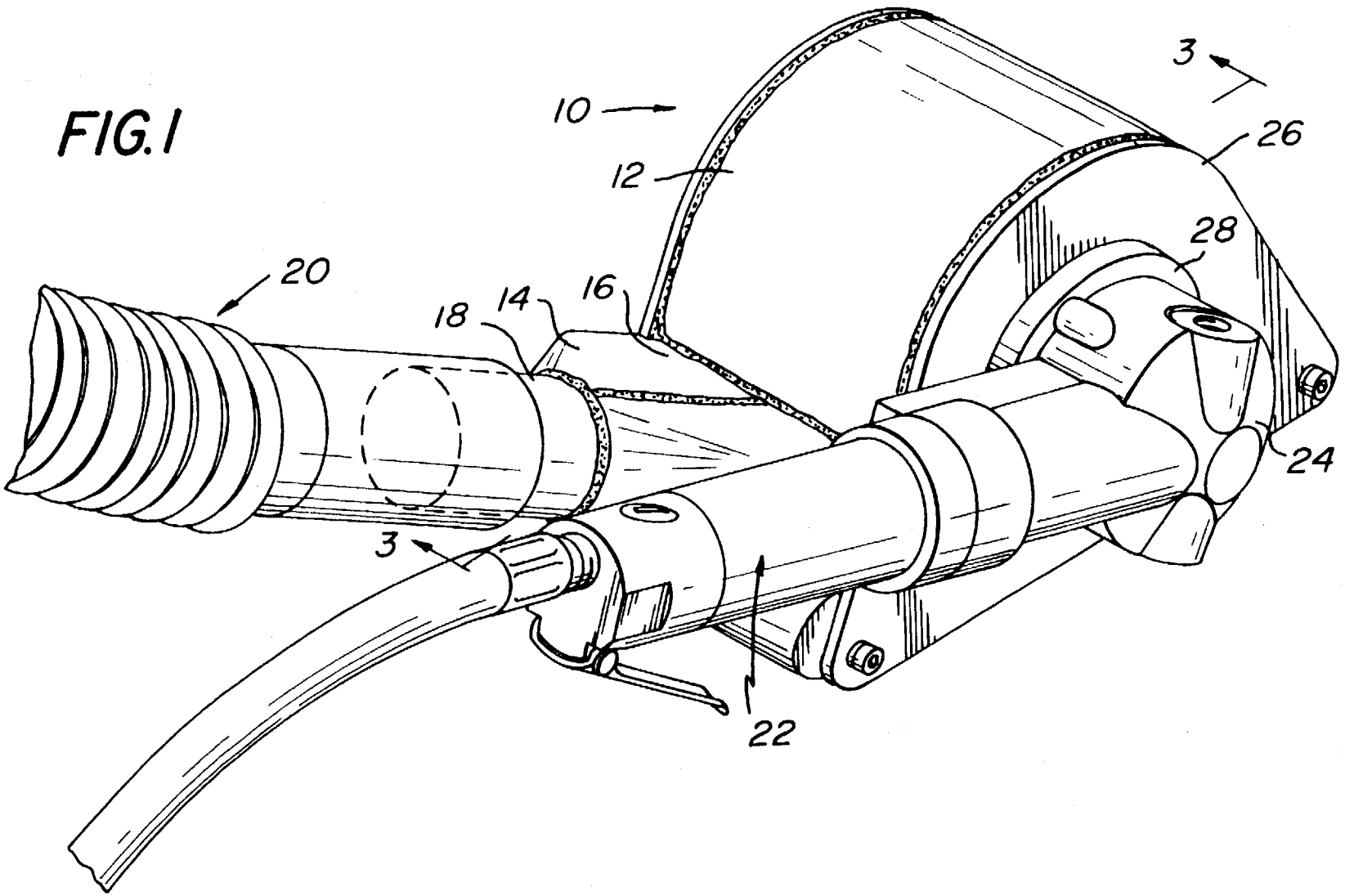
FIG. 1 is an isometric view of a rotary peening tool according to the present invention.

FIG. 1 shows a rotary peening tool 10 for peening a surface to relieve tensile stress and to remove scale, corrosion, paint or other coatings. The peening tool 10 includes a shroud assembly 12 and a funnel portion 14. As best seen in the sectional view of FIG. 3, the funnel 14 opens into the shroud assembly 12 at the funnel's mouth 16, which extends substantially the entire width of the shroud assembly. On its opposite end, the funnel 14 tapers to a cylindrical neck 18 adapted for attachment to a vacuum source 20. Individual features of the invention will be described hereinbelow.

Pneumatic motor

As described in the Background section, the manufacturer of the P-7 roto-peening tools flaps described above has published a recommended tool configuration for using the flaps. More specifically, the manufacturer has recommended that the axis of the hub be mounted at a height above the work surface so as to generate a work surface interference of 3/16th of an inch and that the hub be powered by a 0.6 Hp motor operating in the 2500–3000 rpm range. As stated above, these recommendations produce an impact and subsequent dragging of the peening particles along the work surface which function to scrap the coating off the surface.

To eliminate or alleviate the problems associated with the scraping action of the flaps and to achieve true peening, the recommended height which produced the 3/16th of an inch work surface interference has been adjusted. The work surface interference will more readily be understood by reference to FIG. 4 wherein trajectory A defines the pre-impact path of a peening hub. Point F defines the vertical position of the peening hub if it were not to impact the work surface. The radial distance to point F from point O minus the distance from point O to the coating 76 determines the amount of interference or "work surface interference" of the flaps. This is denoted as WSI in FIG. 4. In order to determine the proper work surface interference, the height of the hub was reduced in 1/16th inch increments. The motion and wear of the flaps was monitored along with the resulting surface finish until the desired near vertical impact of the peening nubs into the work surface was achieved. The result of these tests is that the proper work surface interference for producing true peening is approximately 7/16th of an inch.

Furthermore, it was determined that, in order to provide for proper rebound or recoil of the flaps while maintaining rotational speed, the power of the drive motor had to be increased. A 1.2 horsepower, right-angle pneumatic motor configured to produce a nominal no-load speed of 2500–2700 revolutions per minute (RPM) at 6.3 BAR pneumatic pressure has been found to be sufficient to maintain the rotational speed of a six-slot hub mounted at a drive height to achieve true peening impact. That is, the horsepower of the motor has been chosen to maintain a 2200–2400 RPM of the flaps even after impact with the work surface.

A motor 22 of this type is contained in a motor housing 24 mounted to one side wall 26 of the shroud assembly 12. The pneumatic motor 22 is connected by an air line to a pneumatic source (not shown). It is preferable to use a combined vacuum and pneumatic power source, such as one of the TVS™ systems sold by Trelawny™ Pneumatic Tools, since the combined source ensures that a vacuum will be applied to the shroud at all times while pneumatic power rotates the hub.

The motor housing 24 is mounted to the side wall 26 by attaching the motor housing to a mounting collar 28. In the preferred embodiment, the side wall 26 is formed from ⅛th thick aluminum plate, while the mounting collar 28 is a ⅜th inch thick aluminum annulus. A round hole 30 is formed in the side wall 26, essentially congruent with the open inner circumference of the mounting collar. The hole 30 permits a back flange 32, attached at the end of the rotating spindle of the motor 22, to protrude therethrough. Mounting screws 34 attach the motor housing to the mounting collar 28.

Drive assembly

The motor 22 thus drives the back flange 32. A threaded arbor 36 is attached to the face of the back flange to mount a rotating hub. Because of the increased motor power and the near vertical impact of the peening buttons, the arbor is made more rigid than the comparable rotating arbor on a tool which uses the peening flaps as scrapers, in order to prevent flexing and eccentric motion of the arbor's free end. In this embodiment, the arbor 36 has a ⅝th inch diameter, with eleven-per-inch external threads 38.

A pin retainer flange 40 is threaded onto the arbor 36 and locked thereon by a locking screw (not shown). To facilitate attachment and detachment of the hub to the arbor 36, a spacer nut (94, described in a following section) is disposed between the pin retainer flange 40 and the back flange 32. The pin retainer flange 40 rotates with the arbor 36, and locks the peening flaps to the hub as described below. However, for purposes of this section, it is important to note that pin retainer flange 40 has essentially the same circumference as the hub 42 and that the hub is threaded onto the arbor to press flush against the pin retainer flange. Thus, the entire drive assembly of back flange, arbor, spacer nut, and retainer flange combine with the hub to form a rigid rotating spindle that resists flexing and eccentric motion under the periodic load of high frequency peening impacts.

Rotary hub and flaps

Figure 2:
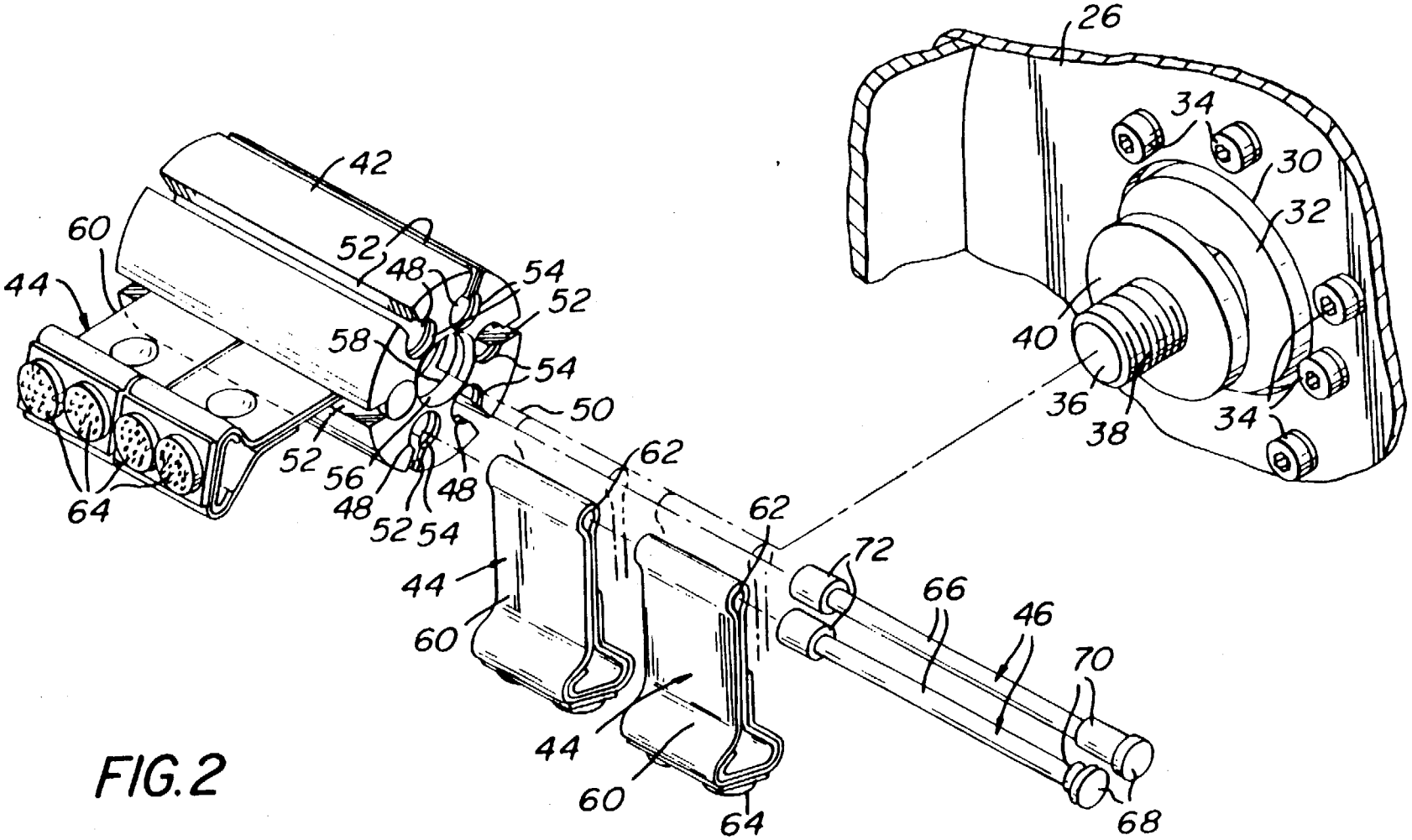
FIG. 2 is exploded illustration of the hub and corresponding threaded arbor attachment of the tool shown in FIG. 1.

FIG. 2 also shows an exploded view of the rotating hub 42, with six pairs of peening flaps 44 attached to it by pins 46. The pins 46 are received in pin bores 48 drilled into the hub 42. The six pin bores 48 are spaced at equal intervals (60° arc) from one another, at substantially the same radial distance from the centerline axis of rotation 50 of the hub. A slot 52 is cut into the hub through and along each pin bore 48, the slots 52 having a sufficient width to accommodate the thickness of the peening flap 44 near its engagement end. Each pin bore 48 also has a concentric shoulder 54 formed into it on one side of the hub 42.

The hub 42 has a threaded bore 56 formed in its center. The internal threads 58 in the bore are configured to mate with the corresponding threads 38 on the arbor. The threaded bore 56 is on the same side of the hub 42 as the shoulders 54 of the pin bores, such that when the hub 42 is threaded onto the arbor 36 flush against the pin retainer flange 40, the pins are prevented from backing out of the hub.

Each peening flap 44 includes a flexible strap 60 which has a looped end 62 for retention in the hub 42. At or near its other end the flap contains two metal buttons, each having hard steel peening particles 64 arranged in a pattern and metallurgically bonded to the button, as described in U.S. Pat. No. 5,203,189.

The pins 46 are designed to retain and stagger the peening flaps 44 in the hub. The looped end 62 of the flexible strap 60 is disposed about a shaft 66 of a pin 46. The length of the pin's shaft 66 depends upon the number of peening flaps 44 to be retained on it. FIG. 2 illustrates two peening flaps 44 on each pin 46, but a smaller tool similar to this design uses a single flap on each pin. The pin 46 has a head 68, a first collar 70 and a second collar 72. The collars 70, 72 are designed to fit within the pin bores 48 and prevent the looped end 62 of the flexible strap 60 from sliding along the shaft 66. The pin's head 68 is designed to seat upon the bore's concentric shoulder 54 and limit the distance that the pin may travel into the bore 48. When the hub 42 is mounted on the arbor 36, the pin heads 68 are disposed against the pin retainer flange 40.

It is desirable to stagger the peening flaps to disperse the points of impact by the peening particles 64 on a work surface. A greater discussion of the reasons for staggering peening flaps is provided in U.S. Pat. No. 5,284,039. In this embodiment, staggering is provided by varying the lengths of the pin shoulder 70 to locate the flaps at different segments along the pin shaft. As is shown in FIG. 2, the peening flaps 44 are staggered in relation to one another by selecting adjacent pins 46 having different shoulder lengths 70.

The shroud assembly

Figure 3:
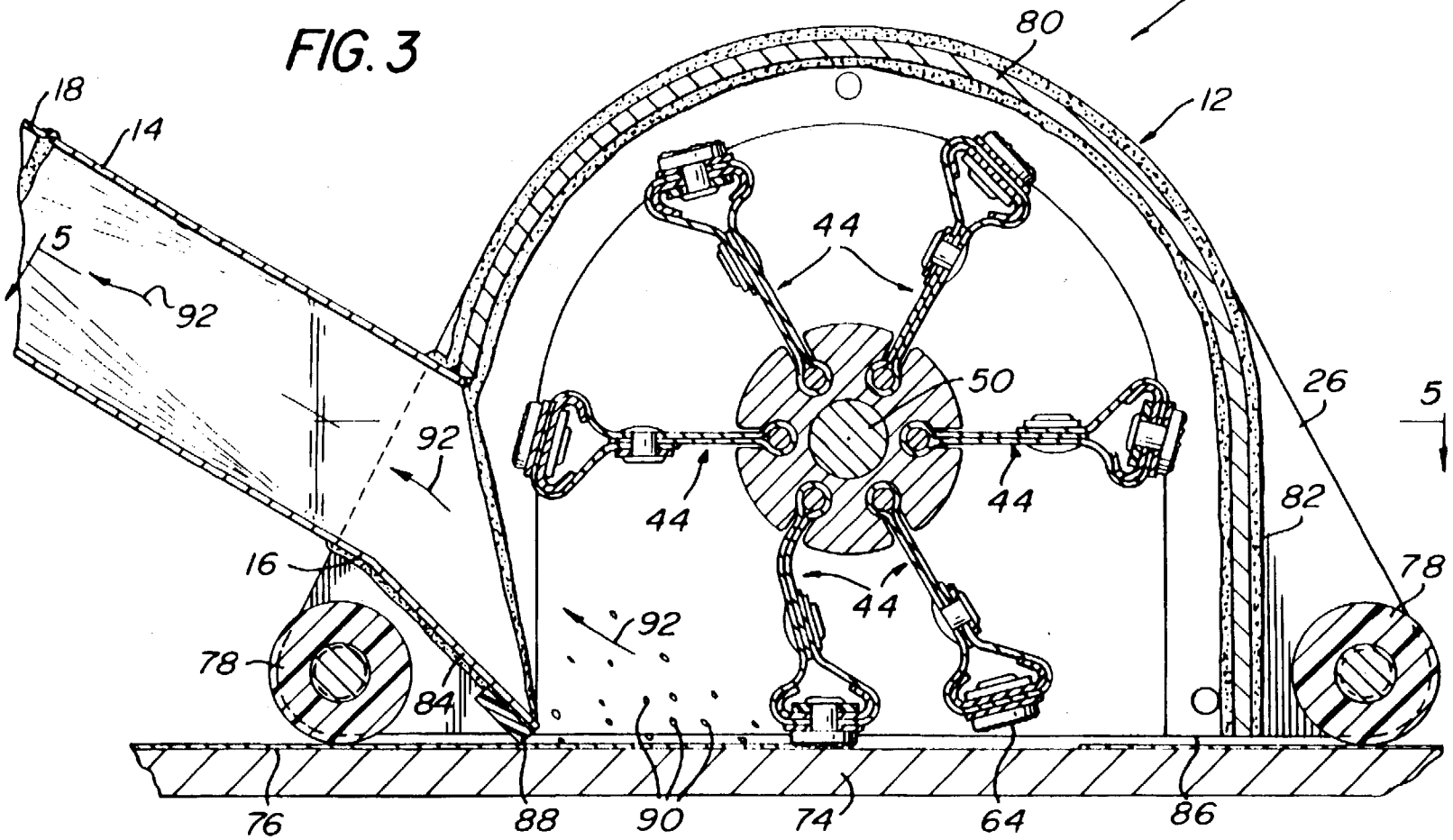
FIG. 3 is a cross-section view of the rotary peening tool of FIG. 1, from line 3—3 and in the direction indicated by the directional arrows.

Referring now to FIG. 3, the rotary peening tool 10 is being moved over and along a metal work surface 74 which has a potentially hazardous surface coating 76, such as chipped lead-based paint and corrosion of the exposed metal. The shroud assembly 12 has two rollers 78 to translate the tool 10 in a level orientation along the work surface 74. One roller 78 is mounted forward of the hub 42 and the other roller 78 is mounted aft of the hub. Each roller 78 extends from and is rotatably attached to the side walls 26 of the shroud 12. The rollers 78 are made from nylon material to minimize weight and to provide low friction and high wear-resistance.

The shroud assembly 12 includes an essentially semicircular hood portion 80 located above the axis of rotation 50 of the hub 42. The hood portion 80 attaches to a front wall 82, with "front" now indicating that the wall is located in the direction of angular rotation of the hub 42 (clockwise in FIG. 3). The front wall 82 extends below the hub's axis of rotation 50. A rear wall 84 is positioned aft of the hub 42 (rear indicating that it is opposite the front wall) and also extends below the hub's axis of rotation. The front wall 82 and side walls 26 of the shroud assembly 12 extend downward and terminate at points which define the open bottom 86 of the shroud in a substantially horizontal plane. The shroud assembly 12 is positioned above the work surface 74 by the rollers 78, which maintain a gap between open bottom of the shroud and the work surface 74 for permitting ambient air to flow into the shroud assembly 12. The position of the hub with respect to the open bottom is such that the peening particles 64 extend through the bottom to contact the work surface 74.

In the depicted embodiment, the gap between the open bottom and the work surface 74 is less than one-half inch and preferably is approximately 1/16th of an inch. The gap dimension is configured to accelerate ambient air from outside the shroud assembly 12 to the inside. When the vacuum source is attached to the funnel neck 18, a suction is generated within the cavity formed by the shroud assembly 12. If the gap between the open bottom and the work surface 74 is properly configured, the vacuum will cause outside ambient air to accelerate under and into the shroud assembly 12, thereby preventing particles 90 of the coating from escaping through the gap and facilitating a smooth directional flow of air into the funnel 14.

The rear wall 84 forms a lip which angles frontward and downward. The rear wall 84 also terminates at a height above the work surface near the horizontal plane of the open bottom 86 (preferably just slightly above the plane of the bottom). Hence, a gap also exists between the rear wall 84 and the work surface 74. A sealing structure associated with the rear wall 84 is designed to substantially block air flow through the gap between the rear wall 84 and the work surface 74. The sealing structure in this embodiment is a resilient sealing strip 88 of synthetic rubber foam, which is attached to the bottom edge of the rear wall 84 and extends below the rear wall 84 a sufficient distance to contact the work surface 74, thereby closing the gap to prevent air from entering the shroud assembly from below the rear wall 84.

The funnel 14 is attached to and extends from the rearward portion of the shroud assembly 12. The mouth 16 of the funnel 14 is connected to the hood 80 of the shroud assembly and to the lip formed by rear wall 84. A sealing strip 88 attached to the rear wall prevents the entrance of air flowing under the rear of the shroud assembly, which would otherwise oppose and disrupt the directional flow into the funnel mouth. As a consequence, the vacuum accelerates ambient air from the outside to the inside of the shroud assembly and, subsequently, directly into the funnel 14 in a relatively smooth airflow. The vacuum source will also assist in holding the tool against the work surface, thereby minimizing the effort that the user must assert.

The funnel portion 14 is mounted to the shroud assembly 12 at an angle with respect to the open bottom which is chosen to correspond to the trajectory of fragments dislodged from the work surface by the peening flaps. For the embodiment depicted and described herein, the angle is between 0 degrees and 90 degrees and preferably between 10 degrees and 45 degrees. More preferably, the angle is approximately 20 degrees. The lip formed by the rear wall 84 further assists in channeling the air flow into the funnel. Thus, the configuration of the shroud assembly 12, the funnel 14, and the funnel mouth 16 operate to smoothly and efficiently direct the dislodged particles 90 into the funnel 14.

Flap trajectory and vertical impact

The hub 42 is supported by the side wall 26 of the shroud assembly 12. It is important that the peening particles 64 impact essentially perpendicular (i.e., normal) to the work surface in order to maximize the compressive forces and minimize the lateral forces imposed on the surface. Lateral forces produce bearing loads on the work surface which tend to generate grooves in the surface. However, a purely perpendicular impact is difficult to achieve due to the rotary nature of the device.

Figure 4:
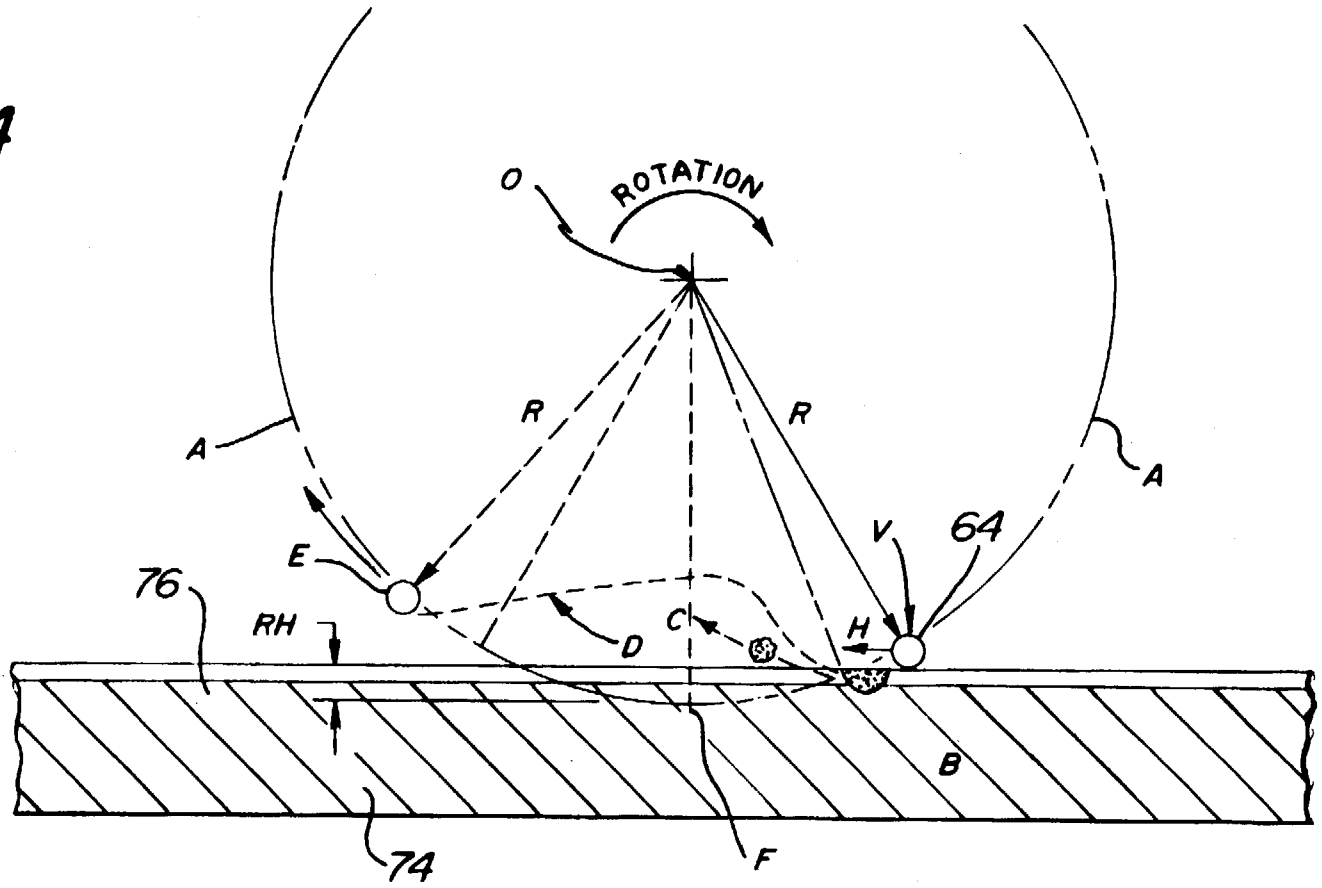
FIG. 4 is a schematic illustrating the preferred trajectory of the peening particles.

The desired trajectory of a peening particle when using the peening tool described herein is depicted in schematic representation in FIG. 4. For simplification, the schematic depicts just one peening particle, or hub, it being understood that several hubs are arranged in a pattern on each of the two buttons on a peening flap. The peening particle 64 is shown at a radius R from the center of rotation following a pre-impact trajectory denoted as A. When the peening particle 64 impacts the work surface 74 essentially perpendicular to the work surface, substantially all of its momentum is applied into the surface as a compressive force, V, with a much lesser amount applied as a lateral load, H. The impact of the peening particle 64 produces an indentation of the surface at point B and fragmentation of the coating. The force and direction of the impact causes the coating fragment to disperse along trajectory C and the nub to rebound off the work surface. The combined recoil momentum of the hubs causes the strap to flex as the peening buttons rebound from the surface, and the peening particle 64 thereafter follows a post-impact trajectory D as the flap is pulled around by the hub until it reaches its normal rotational trajectory again denoted as A, at point E. The ideal trajectory of the peening particle 64 is such that it does not touch work surface 74 after the initial impact until it completes another full revolution, thereby eliminating any drag of the flaps from contact with the work surface. As a result, the impact of the peening particle produces true peening, creating shallow, rounded over-lapping dimples in the surface, stretching it radially from each point of impact and causing cold working and plastic flow which tend to relieve tensile stresses.

As discussed above, the work surface interference of the flaps is denoted as WSI in FIG. 4 and corresponds to the mount that the work surface interferes with the rotation of the flaps. In the preferred embodiment, the work surface interference is approximately 7/16th of an inch. This height is configured to produce the near normal impact and desired recoil of the peening particles to reduce wear of the flaps.

A substantially vertical or perpendicular impact of the peening particles 64 on the work surface 74 is also desirable when the tool is used to remove a coating, rather than for stress-relief alone. The vertical impact of the closely spaced peening hubs tends to fracture the coating 76, breaking the adhesion which holds the coating 76 to the work surface 74, and releasing the fragmented coating as small free particles 90, as shown in FIG. 3. The vertical impact prevents the flaps from dragging along the surface which would cause them to flex and impact each other. The hubs are saved from abrasive wear which would occur if they were scraped along the surface and the space between the nubs does not become clogged with the coating. The flaps used with the present invention last approximately five times longer than flaps used with the prior methods.

Directed air flow

Referring back to FIG. 3, the impact and motion of the peening flaps 44 causes the coating 76 to fragment and dislodge as depicted by reference numerals 90. The combination of the rotary motion of the hub 42, the suction provided by the vacuum source, and the acceleration of the ambient air flow cause the dislodged fragments 90 to flow into the funnel mouth 16, essentially as depicted by the arrows 92 in FIG. 3. The ambient air enters under the shroud only from the gap at the front and side walls. The sealing structure 88 prevents air from entering the shroud assembly from the rear and flowing in a direction which would oppose and disrupt the otherwise directed air flow into the funnel mouth. In addition, the counter-clockwise rotation of the flaps acts as an air pump further directing air flow into the funnel.

It has been determined that when the coating is dislodged by the vertical impact of the peening nubs, the fragments 90 tend to follow an approximately 20 degree trajectory of the work surface. Consequently, the funnel mouth being located at the rear wall at a 20 degree radial location, and having the angled funnel lip formed in the rear wall, efficiently captures the particles 90 carried there by their initial trajectory and the directed air flow. This results in a "one pass" capture, wherein essentially all particles move directly from the surface into the funnel without swirling inside the shroud and flaps.

It has also been found that the directed air flow will cool the peening flaps during operation, thereby minimizing deterioration of the flaps from thermal effects.

Access and flap replacement

Figure 5:
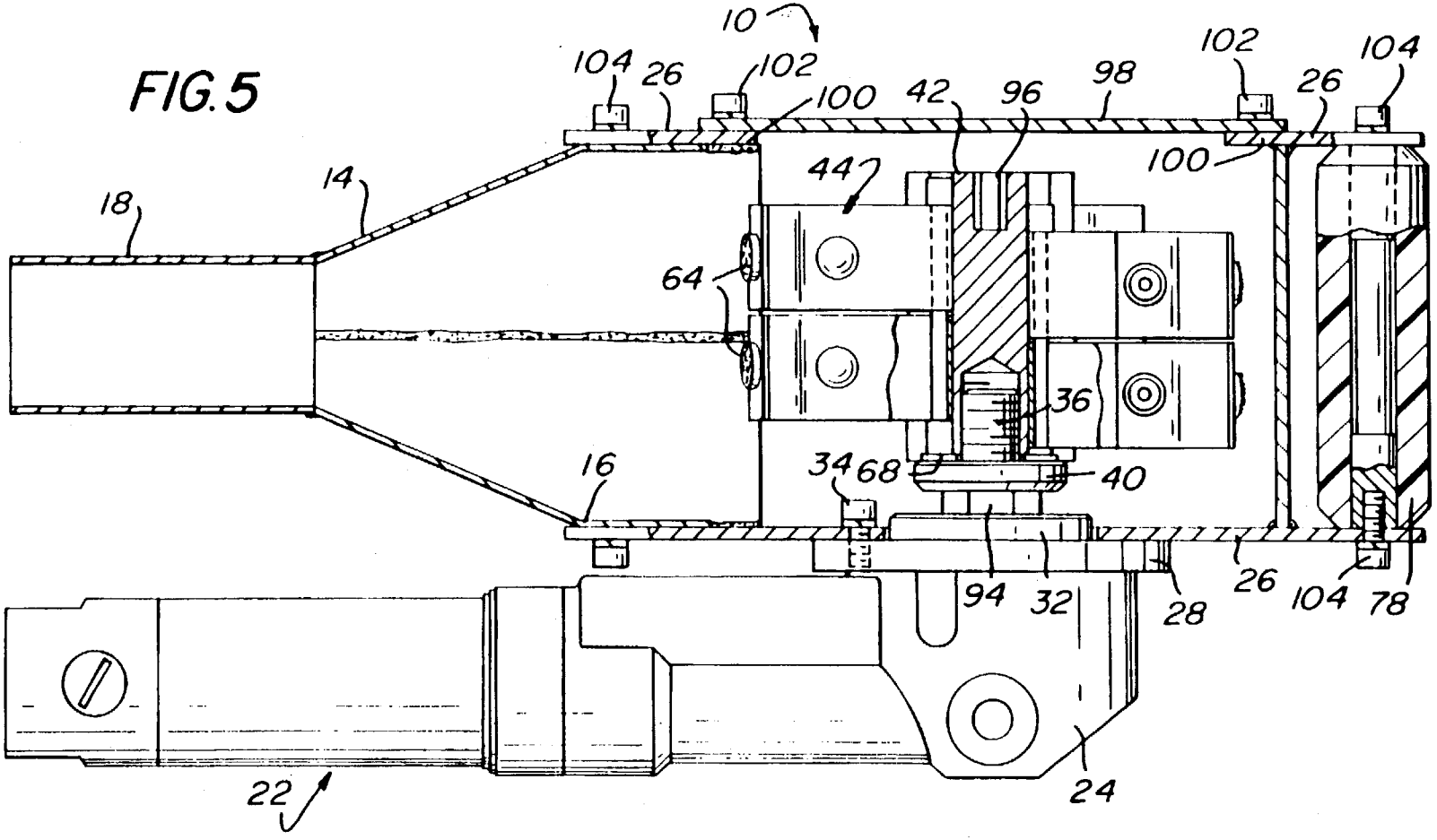
FIG. 5 is a cross-section view of the rotary peening tool of FIG. 3, from line 5—5 and in the direction indicated by the directional arrows.

FIG. 5 depicts a cross-section of the rotary peening tool 10. A keyhole 96, formed on the hub 42, is designed to receive an Allen wrench or a similar type tool to assist in the final tightening and initial loosening of the hub 42. To facilitate the hub's attachment to and detachment from the arbor 36, a spacer nut 94 is disposed on the arbor between the pin retainer flange 40 and the back flange 32. When held by an open-end wrench, the nut 94 will prevent the rotation of the arbor 36 permitting the hub 42 to be rotated by hand or by the Allen wrench. To further simplify the process, the open-end wrench need not be held with the other hand, inasmuch as rotation of the wrench is inhibited when its handle bears against a mounting fastener 34 which projects from the side wall 26.

While the hub 42 has been discussed herein as mounting peening flaps, the hub may be removed and replaced with other surface preparation hubs, e.g., star cutter hubs or hammer hubs. Access to the hub 42 is provided through a removable panel 98 formed in one of the side walls 26. The removable panel 98 is attached to a fixed frame portion 100 of the side wall 26 by fasteners 102. When flap replacement is necessary or the hub 42 is required to be replaced with another device, the access fasteners 102 are simply removed and the removable panel detached to provide access.

FIG. 5 also illustrates the preferred roller configuration wherein each nylon roller 78 is rotatably mounted on an axle which extends between the side walls 26. The axle is mounted to the side walls 26 by fasteners 104, which can be removed to replace the nylon roller. The rollers extend essentially the full length between the side walls, with a small clearance to prevent binding against the side walls.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed is:

1. A surface preparation tool for peening and removing a coating from a work surface, the tool including a rotating hub which retains a plurality of peening flaps of the type in which a flexible strap is attached to the hub at one of its ends and contains one or more peening particles at or near its other end, wherein the peening particles impact the work surface as the hub rotates and cause the coating to fragment and dislodge from the work surface, the tool comprising:

(a.) a shroud assembly supporting and enclosing the rotating hub, the shroud assembly having an enclosed top and an open bottom defined by a front wall located in the direction of angular rotation of the hub, a rear wall located behind the hub and opposite the front wall, and two side walls, each side wall connected to the front and rear walls on opposite sides of the shroud assembly, one of the side walls supporting the hub;

(b.) a funnel having a funnel mouth on one end thereof attached to the rear wall of the shroud assembly, and having a neck on the other end thereof adapted for attachment to a vacuum source, the funnel tapering between the funnel mouth and the neck;

(c.) the open bottom of the shroud assembly being located below the hub at a distance sufficient to cause the peening particles to extend therethrough and impact the work surface during rotation of the hub;

(d.) at least two rollers rotatably attached to the shroud assembly for permitting translation of the tool along the work surface, and for supporting the open bottom above the work surface thereby creating a gap for accelerating ambient air flow from outside of the shroud assembly through the gap into the shroud assembly; and (e.) a sealing structure associated with the rear wall for substantially reducing air flow through the gap between the rear wall and the work surface; wherein the hub is mounted on the side wall at a height such that the peening particles strike the work surface at an angle which is substantially normal to the work surface.

2. The surface preparation tool of claim 1, wherein the funnel mouth extends essentially the full-width between the opposed side walls, and wherein the rear wall of the shroud assembly forms a lip extending frontward and downward from a lower edge of the funnel mouth to the open bottom.

3. The surface preparation tool of claim 2, in which the sealing structure comprises a resilient sealing strip, attached to a bottom edge of the lip and extends below the lip a sufficient distance to contact the work surface and close the gap below the rear wall.

4. The surface preparation tool of claim 2 wherein at least one of the side walls includes a fixed frame member and a removable panel attached to the fixed frame member, the removable panel providing access to the hub for detaching the same from the shroud assembly.

5. The surface preparation tool of claim 1, further comprising said one side wall supporting the hub having a pneumatic motor connected thereto outside the shroud assembly, and a threaded arbor passing through said side wall for mounting the hub thereon, the arbor being rotated by the motor to cause rotation of the hub.

6. The surface preparation tool of claim 1 wherein the funnel forms an angle with the open bottom, the angle defining the flow of the dislodged fragments of the coating after impact by the peening particles.

7. The surface preparation tool of claim 6 wherein the angle is between 0 degrees and 90 degrees.

8. The surface preparation tool of claim 7 wherein the angle is between about 10 degrees and about 45 degrees.

9. The surface preparation tool of claim 8 wherein the angle is approximately 20 degrees.

10. The surface preparation tool of claim 1, wherein the at least two rollers limitation comprises a first roller rotatably mounted on an axle which extends between the side walls in front of the front wall and a second roller rotatably mounted on an axle which extends between the side walls behind the rear wall.

11. The surface preparation tool of claim 1, further comprising a motor for rotating the hub, the motor having sufficient power to maintain the rotation speed of the hub such that each flap does not touch the work surface after its initial impact until the flap completes another full revolution.

12. The surface preparation tool of claim 11, wherein the height at which the hub is mounted produces an approximately 7/16th inch work surface interference of the flaps.

13. A surface preparation tool for peering and removing a coating from a work surface, the tool including a rotating hub which retains a plurality of peening flaps of the type in which a flexible strap is attached to the hub at one of its ends and contains one or more peening particles at or near its other end, wherein the peering particles impact the work surface as the hub rotates and cause the coating to fragment and dislodge from the work surface, the tool comprising:

(f.) a shroud assembly supporting and enclosing the rotating hub, the shroud assembly having an enclosed top and an open bottom defined by a front wall located in the direction of angular rotation of the hub, a rear wall located behind the hub and opposite the front wall, and two side walls, each side wall connected to the front and rear walls on opposite sides of the shroud assembly, one of the side walls supporting the hub;

(g.) a funnel having a funnel mouth on one end thereof attached to the rear wall of the shroud assembly, and having a neck on the other end thereof adapted for attachment to a vacuum source, the funnel tapering between the funnel mouth and the neck;

(h.) the open bottom of the shroud assembly being located below the hub at a distance sufficient to cause the peening particles to extend therethrough and impact the work surface during rotation of the hub;

(i.) at least two rollers rotatably attached to the shroud assembly for permitting translation of the tool along the work surface, and for supporting the open bottom above the work surface thereby creating a gap for accelerating ambient air flow from outside of the shroud assembly through the gap into the shroud assembly; and (j.) a sealing structure associated with the rear wall for substantially reducing air flow through the gap between the rear wall and the work surface; wherein the height at which the hub is mounted on the side wall being selected in relation to the length of the flaps and position of the peening particles on the flaps such that the peening particles make essentially vertical impact to the work surface.

14. The surface preparation tool of claim 13 wherein said hub is positioned at a height above the surface a sufficient distance to produce an approximately 7/16th inch work surface interference of the flaps.

15. A surface preparation tool for peening and removing a coating from a work surface, the tool including a rotating hub which retains a plurality of peening flaps of the type in which a flexible strap is attached to the hub at one of its ends and contains one or more peening particles at or near its other end, wherein the peening particles impact the work surface as the hub rotates and cause the coating to fragment and dislodge from the work surface, the tool comprising:

(k.) a shroud assembly supporting and enclosing the rotating hub, the shroud assembly having an enclosed top and an open bottom defined by a front wall located in the direction of angular rotation of the hub, a rear wall located behind the hub and opposite the front wall, and two side walls, each side wall connected to the front and rear walls on opposite sides of the shroud assembly, one of the side walls supporting the hub;

(l.) a funnel having a funnel mouth on one end thereof attached to the rear wall of the shroud assembly, and having a neck on the other end thereof adapted for attachment to a vacuum source, the funnel tapering between the funnel mouth and the neck;

(m.) the open bottom of the shroud assembly being located below the hub at a distance sufficient to cause the peening particles to extend therethrough and impact the work surface during rotation of the hub;

(n.) at least two rollers rotatably attached to the shroud assembly for permitting translation of the tool along the work surface, and for supporting the open bottom above the work surface thereby creating a gap for accelerating ambient air flow from outside of the shroud assembly through the gap into the shroud assembly; and (o.) a sealing structure associated with the rear wall for substantially reducing air flow through the gap between the rear wall and the work surface; wherein the gap between the open bottom and the work surface is less than one-half inch.

16. The surface preparation tool of claim 15 wherein the gap between the open bottom and the work surface is approximately 1/16th of an inch.

17. A rotary peening tool of the type in which a rotating hub retains a plurality of peening flaps, wherein the flaps are of the type in which a flexible strap is retained in the hub at one of its ends and contains one or more peening particles at or near its other end, the tool comprising:

(p.) a shroud assembly enclosing and supporting the rotating hub, the shroud assembly comprising (i) a hood having an essentially semicircular cross section above the axis of rotation of the hub, (ii) a front wall, connected to the hood in front of the hub, and extending below the axis of rotation of the hub a distance which is less than the extension of the peening ends of the flexible straps from the axis of rotation, (iii) two side walls, each side wall connected to the hood and enclosing an opposite side of the hood, one of the side walls supporting the hub, and each of the side walls extending approximately the same distance below the axis of rotation of the hub as the front wall to form a plane with the front wall;

(iv.) a funnel mouth connected to the hood behind the hub and opposite the front wall, the funnel mouth extending essentially the full-width of the hood between the opposed side walls, and the funnel mouth having a lip which forms a rear wall of the shroud assembly below the hub's axis of rotation;

(b.) a funnel extending from the funnel mouth and reducing to a neck adapted for attachment to a vacuum source;

(c.) at least two rollers rotatably attached to the shroud assembly for permitting translation of the shroud, the rollers being mounted above the plane formed by the front and side walls, the rollers having a diameter of sufficient dimension so as to extend below the plane, the rollers supporting the shroud assembly above the work surface such that a gap is created between the front wall and the side walls for accelerating ambient air flow from outside the shroud assembly through the gap into the shroud assembly; and (d.) sealing means attached to and extending from the lower end of the lip of the funnel mouth, the sealing means having a portion thereof extending below the plane formed by the front and the side walls.

18. The surface preparation tool of claim 17, wherein the at least two rollers limitation comprises a first roller rotatably mounted on an axle which extends between the side walls in front of the front wall and a second roller rotatably mounted on an axle which extends between the side walls behind the rear wall.

19. The surface preparation tool of claim 17, wherein the translating means comprises at least two rollers each rotatably mounted on an axle which extends between the side walls.

20. A surface preparation tool for impacting a work surface comprising:

a shroud assembly;

a hub rotatably disposed within the shroud assembly;

means attached to the hub for impacting the work surface;

means attached to the shroud for translating the same;

a funnel mouth attached to the shroud assembly;

a funnel attached to the funnel mouth and extending to a neck adapted for attachment to a vacuum source, the funnel having a taper along at least a portion of its length between the funnel mouth and the neck;

sealing means attached to the funnel mouth for minimizing the passage of air between at least a portion of the shroud assembly and the work surface; and inlet means for permitting the flow of air into the shroud, the inlet means located forward of the funnel mouth and comprising a gap formed between three sides of the shroud assembly and the work surface for permitting air to flow therebetween.

21. The surface preparation tool according to claim 20 further comprising a motor mounted on the shroud assembly for rotating the hub, an arbor disposed between the motor and the hub, the arbor having threads formed on at least a portion thereof for engaging with corresponding threads on the hub, and a pin retaining flange disposed about the arbor for securing the impacting means onto the hub, and wherein the hub has a plurality of apertures formed therein for accepting a plurality of pins, the pins having a pin head formed on one side and a shaft, wherein at least a portion of the pin head is disposed against the pin retaining flange when the hub is threadingly engaged with the arbor.

22. The surface preparation tool according to claim 20 wherein the impacting means comprises a plurality of peening flaps, the flaps having a looped end for encircling the shaft and thereby attaching the flaps to the hub.

23. The surface preparation tool according to claim 22 wherein the pins furthermore have a shoulder formed thereon for positioning the flaps with respect to the hub.

24. The surface preparation tool according to claim 20 wherein the translation means comprises at least two rollers.

25. The surface preparation tool according to claim 20 wherein said hub is positioned at a height above the work surface so as to produce an approximately 7/16th inch work surface interference of the flaps.

26. A surface preparation tool for peening and removing a coating from a work surface, the tool being of the type in which a rotating hub retains a plurality of peening flaps of the type in which a flexible strap is retained in the hub at one of its ends and contains one or more peening particles at or near its other end, wherein the peering particles impact the work surface as the hub rotates and cause the coating to fragment and dislodge from the work surface, the tool comprising:

(a.) a shroud assembly supporting and enclosing the rotating hub, the shroud assembly having an enclosed top and an open bottom, the shroud assembly defining a cavity;

(b.) at least two rollers mounted on the shroud assembly for permitting translation of the same, the rollers additionally being functional in displacing the open bottom from the work surface a distance of approximately 1/16th of an inch for permitting the passage of air therebetween;

(c.) sealing means attached to the shroud assembly for minimizing the passage of air between a portion of the shroud assembly and the work surface; and (d.) a funnel having a funnel mouth on one end thereof, the mouth being attached to the shroud assembly proximate to the sealing means, the funnel additionally having a neck on the other end thereof, the neck being adapted for attachment to a vacuum source, the funnel tapering between the funnel mouth and the neck, and the funnel furthermore being in fluidic communication with the cavity of the shroud assembly for enabling the air flow and the dislodged fragments to pass therethrough.

27. The surface preparation tool of claim 26, wherein the at least two rollers limitation comprises a first roller rotatably mounted on an axle which extends between the side walls in front of the front wall and a second roller rotatably mounted on an axle which extends between the side walls behind the rear wall.

28. A surface preparation tool for impacting a work surface comprising:

a shroud assembly;

a hub rotatably disposed within the shroud assembly;

means attached to the hub for impacting the work surface, said impacting means including a plurality of flexible peening flaps, the flaps having a first end which is retained by the hub, and a second end which has at least one peening means attached thereto, the peening means having at least one peening particle formed thereon;

a motor source connected to the hub for rotating the same, the motor source having sufficient power to rotate the hub at a desired speed;

means attached to the shroud for translating the same; and wherein the height at which the hub is positioned within the shroud assembly is selected in relation to the length of the flaps, the position of the peening particles on the flaps, and the speed at which the motor source rotates the hub so as to cause the peening particles to make essentially vertical impact with the work surface and to cause the flaps to rebound immediately after impact thereby moving the peening particles away from the work surface as the flap is rotated away from the work surface.

29. The surface preparation tool according to claim 28 wherein said hub is positioned at a height above the work surface so as to produce an approximately 7/16th inch work surface interference of the flaps.

30. The surface preparation tool according to claim 28 wherein the motor has 1.2 horsepower.

31. A surface preparation tool for impacting a work surface comprising:

a shroud assembly;

a hub disposed within the shroud assembly on a rotatable shaft attached to the shroud assembly, the hub being positioned at a desired height within the shroud assembly;

a plurality of flexible peening flaps, each flap having a first end which is retained by the hub, and a second end which has at least one peening particle thereon;

a motor source connected to the hub for rotating the hub, the motor source having sufficient power to maintain the hub rotating at desired speed under load; and the height of the hub and the rotational speed of the hub is such that the peening particles strike the work surface at an angle which is substantially normal to the work surface and such that each flap does not touch the work surface after its initial impact until the flap completes another full revolution.

32. The surface preparation tool of claim 31, wherein the height at which the hub is positioned produces an approximately 7/16th inch work surface interference of the flaps.

33. The surface preparation tool according to claim 31, wherein the motor has 1.2 horsepower.

34. The surface preparation tool of claim 31, further comprising means for translating the shroud assembly.

* * * * *